US006981631B2

(12) United States Patent
Fogle et al.

(10) Patent No.: US 6,981,631 B2
(45) Date of Patent: Jan. 3, 2006

(54) CARTON FOR BRICK-SHAPED CONTAINERS WITH A TOP DISPENSER

(75) Inventors: James C. Fogle, Marietta, GA (US); Raymond R. Spivey, Sr., Mableton, GA (US); Jean-Manuel Gomes, Marietta, GA (US); Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 74 days.

(21) Appl. No.: 10/437,121

(22) Filed: May 13, 2003

(65) Prior Publication Data

US 2004/0226988 A1 Nov. 18, 2004

(51) Int. Cl.
*B65D 5/54* (2006.01)
*B65D 17/28* (2006.01)

(52) U.S. Cl. ..... 229/103.2; 206/431; 229/241

(58) Field of Classification Search ..... 229/103.2, 229/240, 241, 242; 206/427, 431, 434
See application file for complete search history.

(56) References Cited

U.S. PATENT DOCUMENTS 2,383,183 A * 8/1945 Fischer ..... 206/427
2,594,376 A * 4/1952 Arneson ..... 206/172
3,167,214 A * 1/1965 Mahon ..... 229/241
3,747,835 A * 7/1973 Graser ..... 206/154
4,032,053 A * 6/1977 Wilson ..... 229/242
4,034,852 A * 7/1977 Forrer ..... 206/427
4,382,505 A * 5/1983 Sutherland et al. ..... 206/427
4,424,901 A * 1/1984 Lanier ..... 206/434
4,566,593 A * 1/1986 Muller ..... 229/240
4,925,019 A * 5/1990 Ganz et al. ..... 206/427
5,060,804 A * 10/1991 Beales et al. ..... 229/240
5,390,784 A * 2/1995 Sutherland ..... 206/434
5,605,228 A * 2/1997 Baxter ..... 206/427
5,609,251 A * 3/1997 Harris ..... 206/434
6,502,743 B2 * 1/2003 Ikeda ..... 206/427

* cited by examiner

*Primary Examiner*—Gary E. Elkins
(74) *Attorney, Agent, or Firm*—Womble Carlyle Sandridge & Rice, PLLC

(57) ABSTRACT

A carton is provided for containing brick-shaped containers which has a dispenser in the top permitting the removal of any of the containers while maintaining the structural integrity of the carton through the provision of either a top gusset or middle gusset spanning each end of the carton. The top of the carton serves as a dispenser when the dispenser flap is removed.

22 Claims, 4 Drawing Sheets

CARTON FOR BRICK-SHAPED CONTAINERS WITH A TOP DISPENSER

FIELD OF THE INVENTION

This invention relates generally to cartons for brick-shaped containers, such as Tetra Pak®, that has a dispenser in the top for the removal of the containers, but permits the carton to remain intact as a package.

BACKGROUND OF THE INVENTION

Brick-shaped containers made of paperboard and plastic composites for containing drinks have become popular in recent years. One of the popular brands of such containers is Tetra Pak®. These brick-shaped containers with product are sometimes sold as a single package. A number of these containers can be packaged together in plastic wrap. The plastic wrap is destroyed when the package is opened. Paperboard cartons can be used for containing these brick-shaped containers, but they are also destroyed as a package when they are opened to remove one or more containers. It would be desirable to have a package that could be torn open to allow the removal of one or more containers, but would still function as a package for the containers that are not removed.

SUMMARY OF THE INVENTION

It is an object of the present invention to provide a dispenser for a carton for containing brick-shaped containers to allow the removal of one or more containers without destroying the utility of the carton containing the unremoved containers.

The objects of this invention are achieved by providing a carton for the dispenser that can be torn from the top panel and which has gussets at the top or middle of the carton for holding the two side panels together when the dispenser is torn open. This carton permits the removal of one or more containers, but it will still function as a carton for containing the unremoved containers. The top or middle gusset holds the side panels of the carton together forming a secure package even after the removal of the top dispenser flap. The top gusset is simply attached by fold lines to the two side panels by a side gusset on each side. The middle gusset is attached by a tuck-in gusset which is attached to a side gusset which in turn is attached to the middle of each side panel. This permits the middle gusset to span the end wall of the carton near its middle.

The carton of this invention can be held together either by locks or glue on the bottom flaps.

DETAILED DESCRIPTION OF THE PREFERRED EMBODIMENTS

The present invention is intended primarily for use with brick-shaped packages, such as Tetra Pak®, that contain various types of drinks. The brick-shaped containers are constructed of a composite of paperboard and plastic and designed to have a long shelf life without refrigeration.

Figure 1:
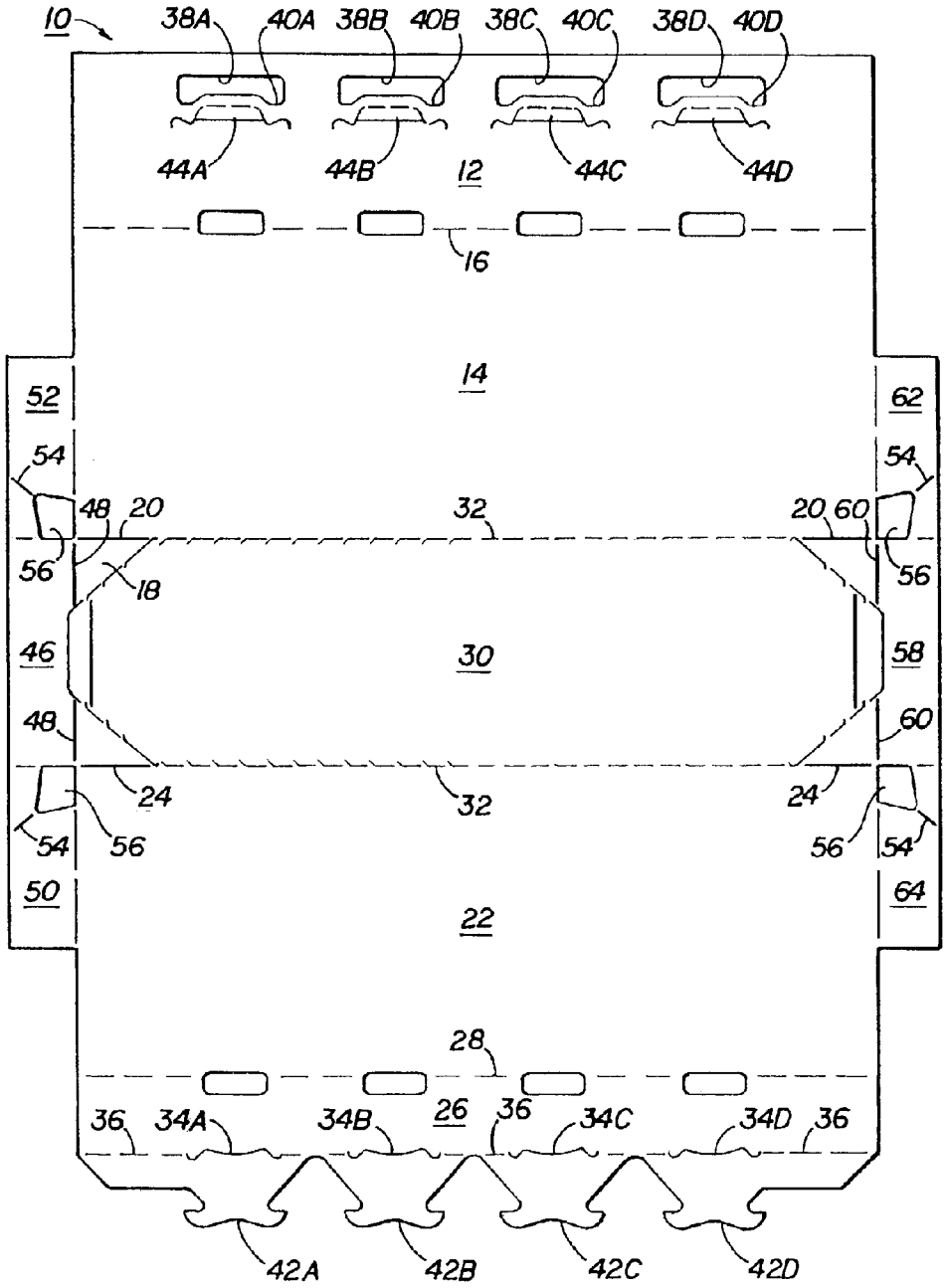
FIG. 1 is a plan view of the blank for containing brick-shaped containers that has a dispenser in the top and a top gusset that spans each end of the carton connecting the side panels together.

The blank for forming the carton of this invention is illustrated in FIG. 1. This blank 10 is designed to contain ten brick-shaped containers C in two rows of five each. The blank 10 is formed from a foldable sheet of material, such as paperboard. The blank 10 has a bottom flap 12, which is foldably connected to side panel 14 by fold line 16 and in turn connected to top panel 18 by fold line 20. Top panel 18 is connected to side panel 22 by fold line 24, which in turn is connected to bottom flap 26 by fold line 28. A dispenser flap 30 occupies nearly all of the top panel 18. The dispenser flap 30 can be torn from the carton along tear line 32 to form a dispenser in the top of the carton.

It should be understood that bottom flaps 12 and 26 can be glued together. However, in this embodiment, a locking system is used which includes both a primary locking system and a secondary locking system. The primary locking system is a locking arrangement between primary male locks 34A–D formed along fold line 36 in bottom flap 26 and primary female openings 38A–D in bottom flap 12. The primary male locks 34A–D are hooked over primary female ledges 40A–D in the locking of the carton. As it is important to tighten the carton tightly about the containers, primary female openings 38A–D also serve as tightening apertures, which allow mechanical tightening fingers to enter and tighten the carton during forming.

The primary locks connect the ends of the carton together via the flaps, while the secondary locks function to main the engaged flaps in place in order to provide a "backup" locking system to prevent the primary locks from separating.

The secondary locking system consists of secondary male locks 42A–D formed as an extension of bottom flap 26. Secondary female openings 44A–D secure the secondary male locks 42A–D when they are inserted into the respective secondary female openings 44A–D.

It will be noticed that each pair of primary and secondary locks are aligned longitudinally, i.e., the length of the blank. This carton provides a locking system that is more secure because there are both primary and secondary locks. While the primary locks connect the ends of the carton together, the secondary locks keep the primary locks engaged.

The carton of this invention has a top gusset 46 that spans one end of the carton. Top gusset 46 is connected to top panel 18 by fold line 48 and is connected to side gusset 50 by fold line 24 and side gusset 52 by fold line 20. Side gussets 50 and 52 serve to hold the top gusset 46 in proper position across the top end of the carton. Fold line 54 may be provided in each side gusset 50 and 52 to facilitate folding the gussets into proper position. Apertures 56 may be provided to facilitate folding. The other end of the carton likewise has a top gusset 58 connected to top panel 18 by fold line 60. Top gusset 58 is connected to side gusset 62 and 64 by fold lines 20 and 24 respectively.

The carton of this invention is formed from the blank of FIG. 1 by moving the top panel along with the dispensing flap 30 over the containers C. The blank 10 can is pulled tight about the containers C and bottom flap 12 and bottom flap 26 are overlapped with bottom flap 26 being on the outside. Primary male locks 34A–D are punched inwardly into primary female openings 38A–D and are locked on primary female ledges 40A–D. The secondary male locks 42A–D are pushed inwardly into secondary female openings 44A–D.

In the process of folding side panels 14 and 22 downwardly, side gussets 50, 52, 62 and 64 are folded inwardly along with top gussets 46 and 58 so that the top gusset 46 and 58 span the end of a carton between the side panels 14 and 12 at the top.

Figure 2:
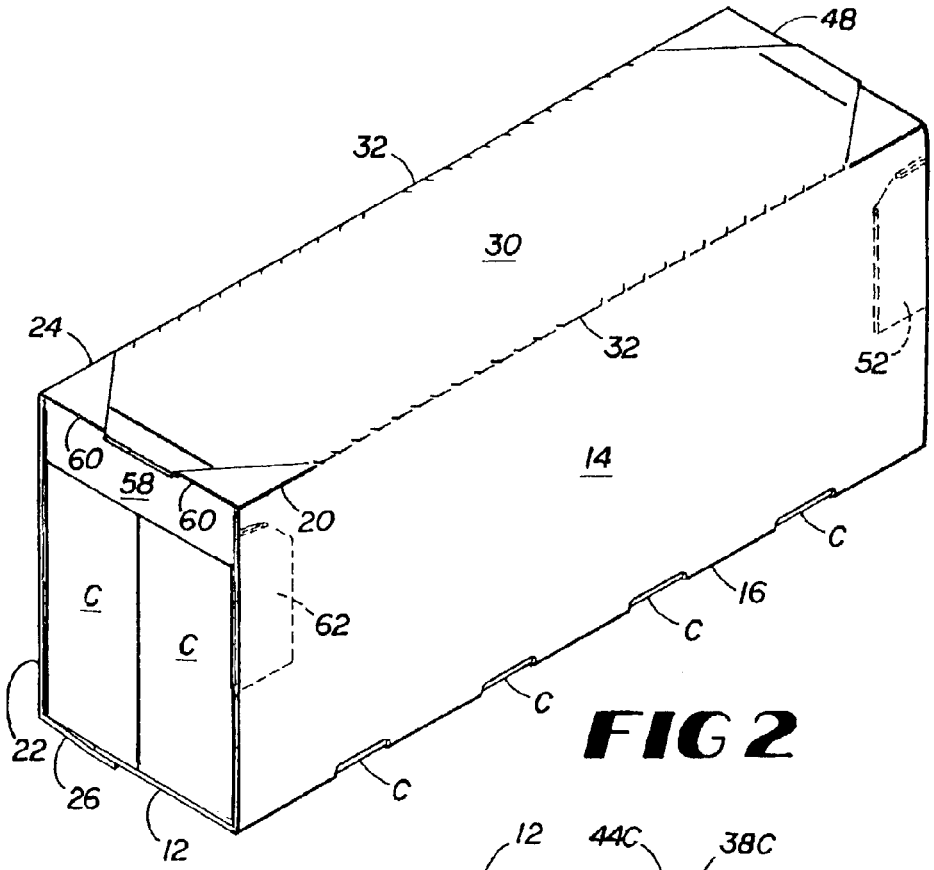
FIG. 2. is a perspective view of a carton drawn from the blank of FIG. 1 and loaded with containers.
Figure 6:
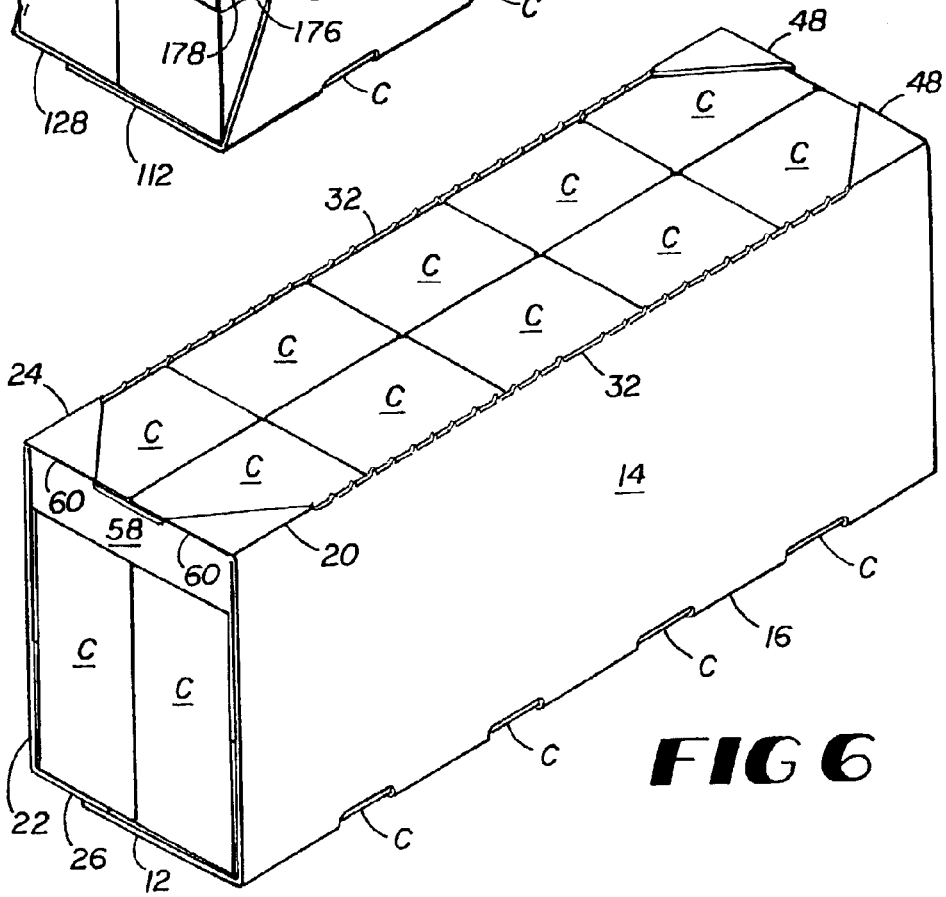
FIG. 6 is a perspective view of the top of the carton of FIG. 2 in which the dispenser top has been removed.

The carton loaded with containers is illustrated in FIG. 2. This carton can be opened by tearing tear line 32 and removing dispenser flap 30. The opened carton with containers C is illustrated in FIG. 6. Even though nearly the entire top panel 18 is removed, the carton is held together by the top gussets 46 and 58 and side gussets 50, 52, 62 and 64 at each end of the carton, thus providing a package for the containers that are not removed.

Figure 3:
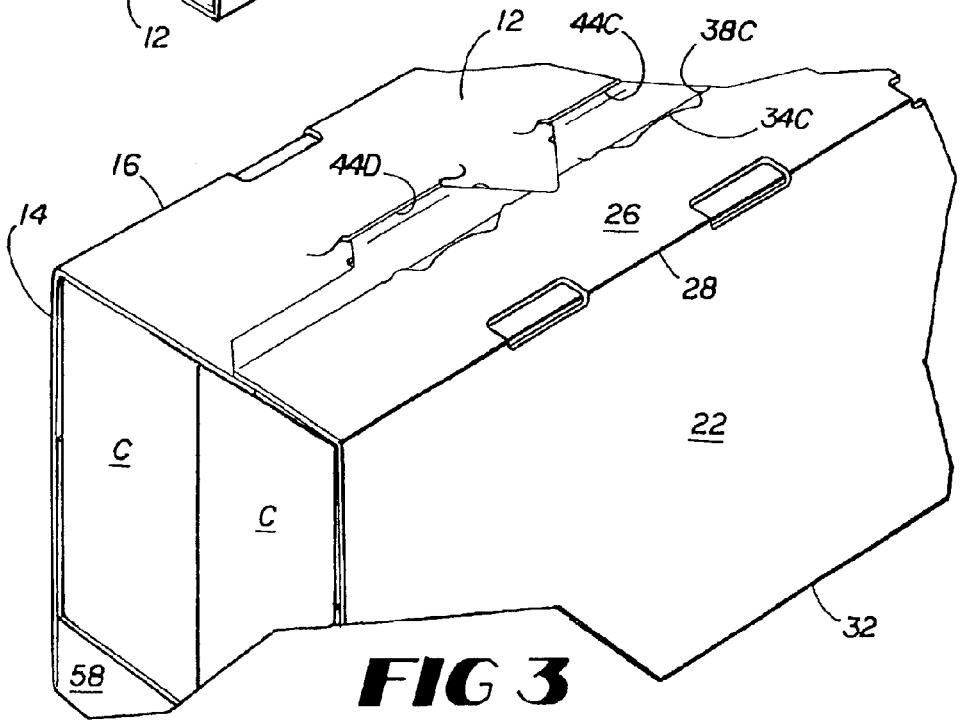
FIG. 3 is a perspective view of the bottom of the carton of FIG. 2 that has been formed from the blank of FIG. 1 and locked.

The primary and secondary locking systems of the present embodiment are illustrated in FIG. 3, which shows the bottom of the carton locked.

Figure 4:
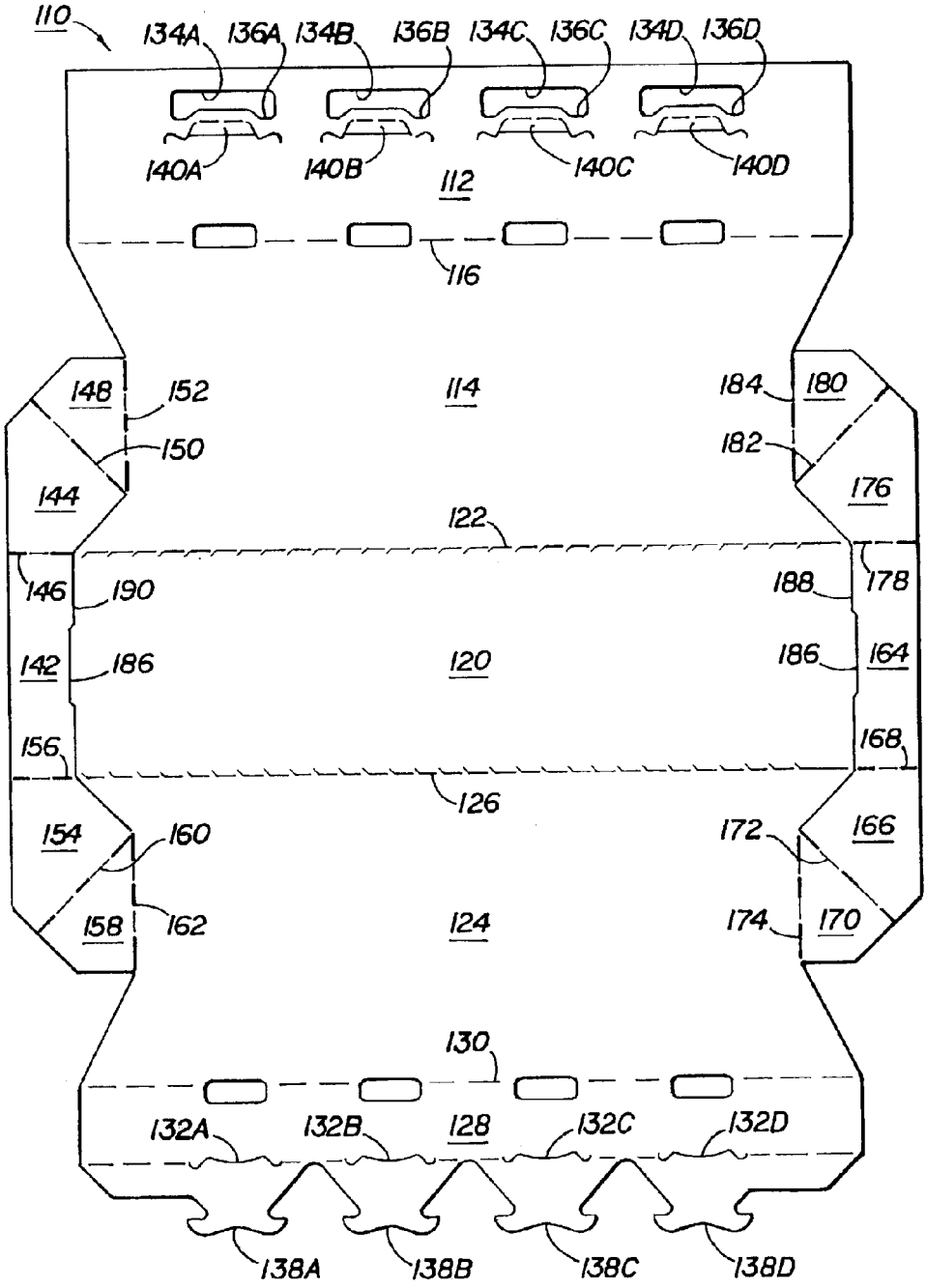
FIG. 4 is a plan view of the blank for forming a carton for containing brick-shaped containers that has a dispenser in the top and a gusset in the middle of each end of the carton for holding the side panels together.

The blank for forming of a carton with the middle gusset is illustrated in FIG. 4. This blank 110 has a bottom flap 112 that is connected to side panel 114 by fold line 116, which is connected to dispenser flap 120 which encompasses the entire top along tear line 122, which in turn is connected opposite side panel 124 by tear line 126. Side panel 124 is connected to bottom flap 128 by fold line 130. This carton has the same locking systems as illustrated in FIG. 1. It has a primary locking system with primary male locks 132A–D formed in bottom flap 128 and primary female openings 134A–D formed in bottom flap 112. Secondary male locks 138A–D are an extension of bottom flap 128 and are locked into secondary female openings 140A–D in bottom flap 112. These locks function in the same way as the locks described in connection with FIG. 1.

The blank 110 illustrated in FIG. 4 has a middle gusset 142 on one end of the carton that is foldably attached to tuck-in gusset 144 by fold line 146, which in turn is connected to side gusset 148 by fold line 150 which in turn is connected to side panel 114 by fold line 152. Middle gusset 142 is connected to tuck-in gusset 154 by fold line 156, which in turn is connected to side gusset 158 by fold line 160 which in turn is connected to side panel 124 by fold line 162. The other end of the carton has a middle gusset 164 which is connected to tuck-in gusset 166 by fold line 168 which in turn is connected to side gusset 170 by fold line 172 which in turn is connected to side panel 124 by fold line 174. Middle gusset 164 is connected to tuck-in gusset 176 by fold line 178 which in turn is connected to side gusset 180 by fold line 182 and in turn connected to side panel 114 by fold line 184. Dispenser flap 120 can be removed by pulling on either tear tab 186 on each end of the carton. The middle gussets 142 and 164 are separated from dispenser flap 120 by cut lines 190 and 188, respectively.

Figure 5:
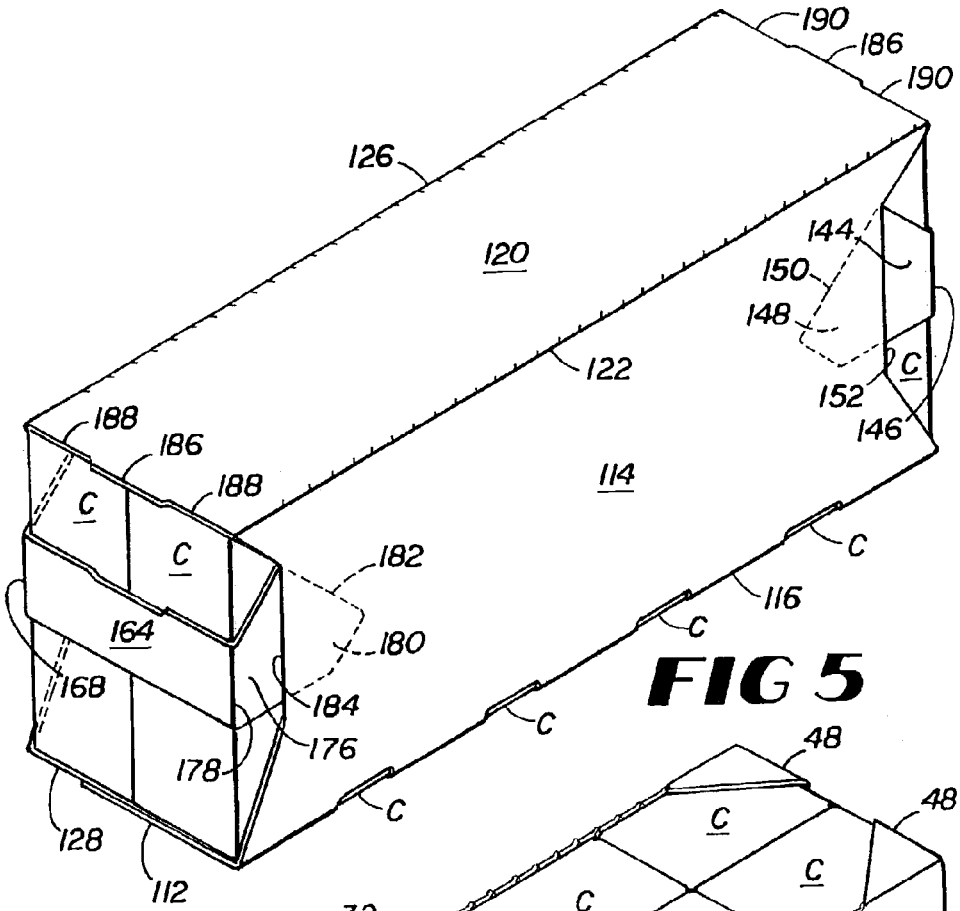
FIG. 5 is a perspective view of the carton formed from the blank of FIG. 4 and loaded with containers.

This carton is formed about containers and locked in the same way as the carton is formed from the blank shown in FIG. 1. A carton formed from the blank illustrated in FIG. 4 is shown in FIG. 5.

However, the middle gussets 142 and 164 of this embodiment span the end of the carton near its center. Tuck-in gussets 144, 154, 166, 176 and side gussets 148, 158, 170 and 180 are folded inwardly in the process of erecting this carton so that they rest between the inside of the side panels 124 and 114 and the containers therein. This results in holding middle gussets 142 and 164 tightly against the ends of the carton and prevents the containers from falling out when the dispensing flap 120 has been removed.

While the invention has been disclosed in its preferred forms, it will be apparent to those skilled in the art that many modifications, additions, and deletions can be made therein without departing from the spirit and scope of the invention and its equivalents as set forth in the following claims.

Unique Features of this Invention

An important unique feature of this invention is that this carton provides a dispenser with easy access to all the containers contained in the carton, but preserves the integrity of the carton in holding containers through the provision of either a top gusset or middle gusset across each end of the carton which holds the containers in place in the carton and holds the carton together.

We claim:

1. In combination, a carton and a plurality of brick-shaped parallelepipedal containers disposed within the carton, the carton comprising:

open ends;

a bottom panel;

a first and a second side panel located between the open ends; and a top dispenser, the first and second side panels being secured to each other when the top dispenser is opened by a gusset spanning and substantially parallel with each open end of the carton and connecting the side panels, wherein the top dispenser is at least partially defined by a first tear line located between the top dispenser and the first side panel and a second tear line located between the top dispenser and the second side panel, and the top dispenser extends across substantially an entire top of the carton, each gusset is located adjacent the top dispenser and is interconnected to the side panels by two side gussets, and at least one of said gussets engages an end of at least one of said containers.

2. The carton of claim 1 in which the bottom panel consists of two overlapping flaps that are locked together by primary and secondary locks.

3. The carton of claim 1 in which the bottom panel consists of two overlapping flaps that are held together by glue.

4. The carton of claim 1 in which the top dispenser is foldably connected to the first side panel at the first tear line.

5. A carton and a plurality of containers contained therein, the carton comprising:

open ends;

a bottom panel;

a first and a second side panel located between the open ends; and a top dispenser, the first and second side panels being secured to each other when the top dispenser is opened by a gusset spanning each open end of the carton and connecting the side walls, wherein the top dispenser is at least partially defined by a first tear line located between the top dispenser and the first side panel and a second tear line located between the top dispenser and the second side panel, wherein each gusset spans an open end of the carton at approximately the center between the top dispenser and bottom panel and is foldably interconnected to and held in position by a tuck-in gusset and side gusset which are folded inside the carton and held in place by the containers when the top dispenser is closed.

6. The carton of claim 5 in which the top dispenser is foldably connected to the first side panel at the first tear line.

7. A carton and a plurality of containers disposed within the carton, the carton comprising:

open ends;

a bottom panel consisting of two overlapping flaps that are locked together by primary and secondary locks;

a first and a second side panel located between the open ends; and a top dispenser, the first and second side panels being secured to each other when top dispenser is opened by a gusset spanning each open end of the carton and connecting the side walls, wherein the top dispenser is at least partially defined by a first tear line located between the top dispenser and the first side panel and a second tear line located between the top dispenser and the second side panel, and the top dispenser extends across substantially an entire top of the carton, and each gusset spans an open end of the carton at approximately the center between the top dispenser and bottom panel and is foldably interconnected to and held in position by a tuck-in gusset and side gusset which are folded inside the carton and held in place by the containers.

8. A carton and a plurality of containers disposed within the carton, the carton comprising:

open ends;

a bottom panel consisting of two overlapping flaps that are held together by glue;

a first and a second side panel located between the open ends; and a top dispenser, the first and second side panels being secured to each other when the top dispenser is opened by a gusset spanning each open end of the carton and connecting the side walls, wherein the top dispenser is at least partially defined by a first tear line located between the top dispenser and the first side panel and a second tear line located between the top dispenser and the second side panel, and the top dispenser extends across substantially an entire top of the carton, and each gusset spans an open end of the carton at approximately the center between the top dispenser and bottom panel and is foldably interconnected to and held in position by a tuck-in gusset and side gusset which are folded inside the carton and held in place by the containers.

9. In combination, a carton and a plurality of brick-shaped parallelepipedal containers disposed within the carton, the carton comprising:

a first open end and a second open end;

a bottom panel;

a first side panel and a second side panel located between the first and second open ends;

a dispenser flap at least partially defined by a first tear line located between the dispenser flap and the first side panel and a second tear line located between the dispenser flap and the second side panel, wherein the dispenser flap extends across substantially an entire top of the carton and allows access to an interior of the carton from above;

a first top gusset adjacent to the dispenser flap and substantially parallel to the first open end, wherein the first top gusset spans the first open end and connects the side walls;

a second top gusset adjacent to the dispenser flap and substantially parallel to the second open end, wherein the second top gusset spans the second open end and connects the side walls;

a first side gusset foldably connected to the first top gusset and connecting the first top gusset to the first side panel; and a second side gusset foldably connected to the first top gusset and connecting the first top gusset to the second side panel, wherein said first side gusset engages an end of at least one of said containers.

10. The carton of claim 9, further comprising:

a third side gusset foldably connected to the second top gusset and connecting the second top gusset to the first side panel; and a fourth side gusset foldably connected to the second top gusset and connecting the second top gusset to the second side panel.

11. The carton of claim 9 in which the dispenser flap is foldably connected to the first side panel at the first tear line.

12. The carton of claim 11 in which the dispenser flap is foldably connected to the second side panel at the second tear line.

13. In combination, a carton and a plurality of brick-shaped parallelepipedal containers disposed within the carton, the carton comprising:

a first open end and a second open end;

a bottom panel;

a first side panel and a second side panel located between the first and second open ends;

a dispenser flap connected to the first and second side panels and at least partially defined by a first tear line located between the first side panel and the dispenser flap and a second tear line located between the second side panel and the dispenser flap, wherein the dispenser flap extends across substantially an entire top of the carton and allows access to an interior of the carton from above;

a first plurality of foldably connected gussets extending across the first open end and connected to the first and second side panels, wherein the first plurality of gussets is spaced from the dispenser flap, and wherein the first plurality of gussets comprises a first middle gusset extending substantially parallel to the first open end;

a second plurality of foldably connected gussets extending across the second open end and connected to the first and second side panels, wherein the second plurality of gussets are spaced from the dispenser flap, and wherein the second plurality of gussets comprises a second middle gusset extending substantially parallel to the second open end; and said first middle gusset engages an end of at least one of said containers.

14. The carton of claim 13 in which the first plurality of gussets further comprises:

a first side gusset foldably connected to the first side panel;

a first tuck-in gusset foldably connected to and overlapping the first side gusset and foldably connected to the first middle gusset;

a second tuck-in gusset foldably connected to the first middle gusset; and a second side gusset foldably connected to and overlapping the second tuck-in gusset.

15. A carton blank, comprising:

a first side panel;

a dispenser flap at least partially defined by at least one tear line extending along a width of the blank, the dispenser flap being foldably connected to the first side panel;

a second side panel foldably connected to a side of the dispenser flap opposite to the first side panel;

at least one bottom flap foldably connected to at least one of the first and second side panels; and a first plurality of gussets extending along a length of the blank and connecting the first and second side panels, wherein the first plurality of gussets comprises: a first side gusset foldably connected to the first side panel; a first top gusset foldably connected to the first side gusset and adjacent to the dispenser flap; and a second side gusset foldably connected to the first top gusset and foldably connected to the second side panel, wherein the at least one tear line comprises:

a first tear line located between the dispenser flap and the first side panel and extending along the width of the blank; and a second tear line located between the dispenser flap and the second side panel and extending along the width of the blank, wherein the dispenser flap extends across substantially the entire width of the blank and the dispenser flap is separated from the first top gusset by a cut line.

16. The carton blank of claim 15, further comprising a second plurality of gussets connecting the first and second side panels.

17. The carton blank of claim 16, wherein the second plurality of gussets comprises:

a third side gusset foldably connected to the first side panel;

a second top gusset foldably connected to the third side gusset and adjacent to the dispenser flap; and a fourth side gusset foldably connected to the second top gusset and foldably connected to the second side panel.

18. The carton blank of claim 15, further comprising: dispenser flap; and a fold line in the first side gusset extending away from the first aperture.

19. The carton blank of claim 15, wherein the first plurality of gussets is foldably attached to an edge of the first side panel.

20. The carton blank of claim 16, wherein the first plurality of gussets is foldably attached to a first edge of the first side panel, and the second plurality of gussets is foldably attached to a second edge of the first side panel.

21. A carton blank, comprising:

a first side panel;

a dispenser flap at least partially defined by at least one tear line extending along a width of the blank, the dispenser flap being foldably connected to the first side panel;

a second side panel foldably connected to a side of the dispenser flap opposite to the first side panel;

at least one bottom flap foldably connected to at least one of the first and second side panels; and a first plurality of gussets extending along a length of the blank and connecting the first and second side panels, wherein the first plurality of gussets comprises: a first side gusset foldably connected to the first side panel; a first tuck-in gusset foldably connected to the first side gusset and adjacent to the first side panel; a first top gusset foldably connected to the first tuck-in gusset and adjacent to the dispenser flap; a second tuck-in gusset foldably connected to the first top gusset and adjacent to the second side panel; and a second side gusset foldably connected to the first tuck-in gusset and foldably connected to the second side panel; wherein the at least one tear line comprises:

a first tear line located between the dispenser flap and the first side panel and extending along the width of the blank; and a second tear line located between the dispenser flap and the second side panel and extending along the width of the blank, wherein the dispenser flap extends across substantially the entire width of the blank and the dispenser flap is separated from the first top gusset by a cut line.

22. The carton blank of claim 21, further comprising a second plurality of gussets connecting the first and second side panels.

* * * * *

UNITED STATES PATENT AND TRADEMARK OFFICE

CERTIFICATE OF CORRECTION

PATENT NO. : 6,981,631 B2
APPLICATION NO. : 10/437121
DATED : January 3, 2005
INVENTOR(S) : Fogle et al.

It is certified that error appears in the above-identified patent and that said Letters Patent is hereby corrected as shown below:

Column 8, claim 18, line 2, before "dispenser flap" add -- a first aperture in the first side gusset proximate to the first side panel and the --.

Signed and Sealed this

Fifteenth Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 6,981,631 B2
APPLICATION NO. : 10/437121
DATED : January 3, 2006
INVENTOR(S) : Fogle et al.

It is certified that error appears in the above-identified patent and that said Letters Patent is hereby corrected as shown below:

Column 8, claim 18, line 2, before "dispenser flap" add -- a first aperture in the first side gusset proximate to the first side panel and the --.

This certificate supersedes Certificate of Correction issued August 15, 2006.

Signed and Sealed this

Nineteenth Day of September, 2006

JON W. DUDAS
*Director of the United States Patent and Trademark Office*